US009816702B2

(12) United States Patent
Eckert et al.

(10) Patent No.: US 9,816,702 B2
(45) Date of Patent: Nov. 14, 2017

(54) WASTE FEED DEVICE

(71) Applicant: HITACHI ZOSEN INOVA AG, Zürich (CH)

(72) Inventors: Stephan Eckert, Frick (CH); Mihael Vlah, Beringen (CH)

(73) Assignee: HITACHI ZOSEN INOVA AG, Zurich (CH)

( * ) Notice: Subject to any disclaimer, the term of this patent is extended or adjusted under 35 U.S.C. 154(b) by 432 days.

(21) Appl. No.: 14/559,539

(22) Filed: Dec. 3, 2014

(65) Prior Publication Data

US 2015/0159864 A1 Jun. 11, 2015

(30) Foreign Application Priority Data

Dec. 6, 2013 (EP) ..... 13005687

(51) Int. Cl.
*F23G 5/44* (2006.01)
*F23K 3/00* (2006.01)

(52) U.S. Cl.
CPC ..... *F23G 5/444* (2013.01); *F23K 3/00* (2013.01); *F23G 2205/00* (2013.01); *F23G 2205/14* (2013.01)

(58) Field of Classification Search
CPC .. F23G 5/444; F23G 2205/00; F23G 2205/10; F23G 2205/101; F23G 2205/12; F23G 2205/121; F23G 2205/122; F23G 2205/13; F23G 2205/124; F23G 2205/125; F23G 2205/16; F23K 3/00; F23K 3/06
See application file for complete search history.

(56) References Cited

U.S. PATENT DOCUMENTS 1,561,733 A 11/1925 Lenk
3,031,982 A 5/1962 Gordon
4,806,056 A * 2/1989 Rouse ..... F23K 3/00 406/57

FOREIGN PATENT DOCUMENTS

DE 1934916 A1 1/1971
DE 202010011448 U1 5/2011
EP 2381174 A1 10/2011
EP 2618086 A1 7/2013
KR 101246174 B1 3/2013

OTHER PUBLICATIONS

May 14, 2014 Search Report issued in European Application No. 13005687.2.

* cited by examiner

*Primary Examiner* — David J Laux
(74) *Attorney, Agent, or Firm* — Oliff PLC

(57) ABSTRACT

The present invention relates to a waste feed device for feeding waste into a combustion space of a waste incineration plant, including a waste feed shaft wall surrounding a waste feed shaft. In this case, at least part of the waste feed shaft wall is formed from a multiplicity of separate panels which are connected releasably to one another and which comprise, on their side facing the waste feed shaft, a panel inner wall and, on their side facing away from the waste feed shaft, a panel outer wall which is spaced apart from the panel inner wall and which with the panel inner wall surrounds a panel cavity.

15 Claims, 5 Drawing Sheets

WASTE FEED DEVICE

The invention relates to a waste feed device for feeding waste into a combustion space of a waste incineration plant and also to a panel for such a waste feed device.

Generic waste feed devices are known in the industrial sector and comprise, in general, a pour-in hopper, into which the waste is poured from a waste bunker by means of a crane, and a waste shaft which is arranged downstream of this in the waste flow direction and via which the waste is delivered to a charging device, by means of which it is introduced into the combustion space in a controlled way, preferably using feed rams.

The waste feed shaft is surrounded by a waste feed shaft wall which is carried by a supporting frame. With a view to as space-saving a design as possible, in known waste feed shaft devices the supporting frame is formed as an integral part of the waste feed shaft wall. In concrete terms, the waste feed shaft wall, which is itself formed from plates welded to one another, is placed onto the supporting frame. When the waste incineration plant is in operation, the supporting frame is located in the zone of thermal influence of the combustion space.

In order, in the event of a fire backdraft, to attenuate the thermal load upon the waste feed shaft wall together with the integrated supporting frame, both the waste feed shaft wall and the supporting frame are often cooled by means of a cooling medium.

Since the waste feed shaft wall is also exposed to very high mechanical loads during operation, moreover, wearing plates are usually welded onto its side facing the waste feed shaft or waste. In these known embodiments, weld seams are often formed on that side of the waste feed shaft wall which faces the waste feed shaft. In the event of a fire backdraft, these weld seams may fail, and this may lead to leakage of the cooling medium into the waste feed shaft and ultimately to a failure of overall cooling.

Particularly with regard to the supporting frame arranged in the immediate vicinity of the combustion space, even if the supporting frame is cooled, the thermal load in the event of a fire backdraft may be so high that failure of the supporting structure occurs.

Moreover, as regards the wearing plates provided in the known versions, there is the problem that these may bend outward or come loose because of the thermal load. This, in turn, may lead to the formation of bridges and therefore to the impairment of a continuous waste flow through the waste feed shaft.

In the event of damage, in known embodiments a repair is possible often only to a limited extent or at great outlay, this being, inter alia, because the individual parts are very large and heavy and are also often composed of a multiplicity of individual components welded together. To repair said parts, therefore, complicated building work is necessary, which, as a rule, also involves time-intensive welding work.

On the basis of the prior art, the object of the present invention is to make available a waste feed device which ensures high operating reliability and can be maintained at relatively low outlay.

The invention is achieved by means of a waste feed device as claimed in claim 1. Preferred embodiments are defined in the dependent claims.

According to claim 1, the invention relates to a waste feed device for feeding waste into a combustion space of a waste incineration plant, comprising a waste feed shaft wall surrounding a waste feed shaft.

According to the invention, in this case, at least part of the waste feed shaft wall is formed from a multiplicity of separate panels which are connected releasably to one another and which comprise, on their side facing the waste feed shaft, a panel inner wall and, on their side facing away from the waste feed shaft, a panel outer wall which is spaced apart from the panel inner wall and which with the panel inner wall surrounds a panel cavity. The panels are in this case, as a rule, releasable independently of one another.

By at least part of the waste feed shaft wall being divided into separate panels connected releasably to one another, the present invention makes it possible, in the event of damage, to release the panel affected by the damage from the composite structure of the panels and to lift it out, for example, by means of a crane. On account of the relatively low weight or relatively small dimensions of the individual panels, repair work thus becomes, overall, very much simpler than in known versions. Thus, in order to lift out the affected panel, even cranes with a relatively low load-bearing capacity can be used, which are sometimes already present in the plant and therefore do not have to be installed separately (as is the case, for example, with regard to the waste crane). Moreover, on-the-spot welding work, such as is necessary, for example, for the previously known designs welded together completely, is unnecessary for the subsequent repair. Instead, the welding can be carried out, even before installation, under markedly more beneficial workshop conditions.

Since the waste feed shaft wall or part of the waste feed shaft wall is formed from panels connected releasably to one another, in particular from panels screwed to one another, moreover, a waste feed shaft wall inner surface can be obtained which is essentially free of weld seams. The above-described problem of previously known devices, that weld seams fail in the event of a fire backdraft and may lead to leakage of the cooling medium into the waste feed shaft and/or may disturb the continuous waste flow by being bent out/by coming loose, can thus be effectively prevented according to the present invention, thereby contributing to high operating reliability of the waste feed device.

The panel cavity is preferably intended for receiving a cooling medium during operation and, in particular, to have a cooling medium flowing through it. As a result, the panel cavity forms a cooling surface which, in the event of a fire backdraft, effectively attenuates the thermal load upon the panel. Since each panel defines a panel cavity which can be shut off separately from the supply of cooling medium, the present invention makes it possible that, even in the event of a leakage, only the damaged panel, but not the entire waste feed shaft wall, is affected by the failure of cooling, as stated further below.

The cooling medium used is, as a rule, water.

According to an especially preferred embodiment, the waste feed shaft wall inner surface, that is to say the surface which comes directly into contact with the waste when the waste feed device is in operation, is formed directly by the panel inner wall. In other words, in this embodiment, there are no wearing plates additionally welded on the inside. Since there are therefore no further layers, such as, for example, wearing plates, on the side facing the waste feed shaft, very good transmission of heat to the cooling medium can be ensured by this embodiment.

According to an especially preferred embodiment of the invention, the waste feed device comprises a supporting frame for carrying the panels of the waste feed shaft wall, the supporting frame being arranged on the outside, facing away from the waste feed shaft, of the waste feed shaft wall and being connected releasably to the panels of the waste feed shaft wall. Since the cooling surface formed by the panel cavity together with the cooling medium contained therein is always present between the supporting frame and the waste feed shaft during operation, the supporting frame is effectively protected from high thermal load even in the event of a fire backdraft, thus contributing to a high resistance of the waste feed device, overall, and therefore also to high operating reliability. Since the supporting frame lies outside the zone of thermal influence, moreover, cooling of the supporting frame may be dispensed with, as a result of which its design is greatly simplified.

With a view to as high protection as possible against thermal load and to the simple removability of individual panels forming the waste feed shaft wall, according to an especially preferred embodiment the supporting frame is arranged so as to be spaced apart from the waste feed shaft wall. It is conceivable, for example, that the waste feed shaft wall is supported on the carrier element, spaced apart from it, by means of vertical supporting elements, such as, for example, brackets.

In addition to the supporting frame, for static reasons, at least one binding band, likewise arranged on the outside, facing away from the waste feed shaft, of the waste feed shaft wall and connected releasably to the waste feed shaft wall, may optionally be provided. This binding band, too, like the supporting frame, lies outside the zone of thermal influence, with the result that cooling may also be dispensed with for the binding band.

As mentioned, according to the invention, the panels are connected releasably to one another. In this regard, it is especially preferable that in each case two adjacent panels are connected to one another via a screw connection.

With a view to a simple design, to the avoidance of horizontal steps, offsets and disturbing edges and to better cooling, and, moreover, in order to ensure that a panel can be lifted out of the composite panel structure as simply as possible, it is preferable, further, that the connecting line between two adjacent panels runs parallel to the axial direction of the waste feed shaft, that is to say, as a rule, vertically. Before being lifted out, the affected panel is released from the adjacent panels and from the supporting frame, usually taking the form of a horizontal steel profile (and, if appropriate, from one or more horizontal binding bands) and is then lifted upward in the vertical direction.

As is also stated in connection with the figures, particularly in this embodiment, the connection of two panels located next to one another can take place by means of screw connection, the U-profiles, arranged in each case on the longitudinal sides, of both panels being screwed to one another. The U-profiles have, for this purpose, corresponding screw holes.

According to a further preferred embodiment, the panel inner wall is formed continuously at least in its extent in the axial direction of the waste feed shaft, that is to say in the vertical direction. In this case, as a rule, it is formed continuously over the entire height of the waste shaft. Especially preferably, the panel inner wall is formed from a single continuous plate. It is conceivable, for example, that the plate is formed from a sheet metal, known to a person skilled in the art, with weld claddings, or from S235 sheet metal.

In said preferred embodiment, the panel inner wall is, in other words, free of weld seams, in particular of horizontally running weld seams. Since the weld seams in previously known devices are especially susceptible to failure under thermal load and, precisely when they run horizontally, they may lead, upon failure, to steps or bridges disturbing the waste flow, the operating reliability of the waste feed device can be increased, as compared with these previously known devices, by means of this embodiment.

According to a further preferred embodiment, either one or both of the panel inner wall and the panel outer wall is or are formed of a plane plate, in other words a plane that is flat or level. In this regard, it is further preferred that the planes of the plates run parallel to each other. According to a particularly preferred embodiment, the panel is, thus, plane.

As is likewise mentioned above, the panel cavity is preferably cooled by means of a cooling medium and in this case, especially preferably, has the cooling medium flowing through it. With a view to optimal cooling, for this purpose, deflecting ribs preferably running parallel to one another are arranged between the panel inner wall and the panel outer wall in order to deflect the cooling medium. As a rule, the deflecting ribs in this case run at right angles to the axial direction of the waste feed shaft, that is to say horizontally.

In this regard, it is especially preferable that in each case two deflecting ribs which succeed one another in the axial direction of the waste feed shaft are arranged so as to be offset to one another. Thus, the cooling medium follows a meandering flow path and the panel is cooled reliably at every point. By the prolongation of the travel of the cooling medium through the panel cavity being achieved, overall, an increased transmission of heat to the cooling medium and therefore, ultimately, optimal cooling are obtained. Furthermore, it may be preferable in this regard that, for example, the distance between two successive panels is shorter in a first region of the panel than in a second region. Thus, for example, for the lower part which is exposed to especially high thermal load in the event of a fire backdraft, a further prolongation of the flow path of the cooling medium can achieve a greater cooling action than is necessary for an upper part which is subjected to less thermal load.

The feature that the deflecting ribs are arranged so as to be offset to one another is to be interpreted broadly in the context of the present invention and comprises any embodiment which causes two flow passages succeeding one another in the longitudinal direction to be arranged so as to be offset in the width direction.

According to a further preferred embodiment, at least some of the panels are assigned in each case a cooling medium supply line issuing into the panel cavity. What is achieved thereby is that, in the event of a leakage, this is restricted only locally to the panel affected by it, whereas the other panels or the cooling of these panels are not affected by this.

In the event of a leakage, it is preferable that the cooling medium supply is interrupted only to the panel affected by the leakage. In order to ensure this, according to a further preferred embodiment, the cooling medium supply line is assigned means for interrupting the supply of cooling medium to the respective panel cavity. Thus, in the event of damage, for the panel affected by the damage the supply of cooling medium to the corresponding panel cavity can be interrupted separately, whereas it is maintained for the panel cavity of the remaining panels. The means may, for example, take the form of shut-off fittings known to a person skilled in the art.

As a rule, the cooling medium supply line supplying the cooling medium issues into a lower region of the panel cavity, through which the cooling medium flows from a lower end region as far as an upper end region. The cooling medium passes from the upper end region, for example, into an overflow gutter, where it collects and is available for further use, for example for a further section to be cooled of the waste feed device, or is delivered for recooling.

As is also stated in connection with the figures, the waste feed shaft has in cross section a rectangular shape.

Since the shape of the waste feed shaft is rectangular in cross section, the waste feed shaft wall is formed from four subwalls, two longitudinal side walls and two wide side walls.

According to a preferred embodiment, the overall number of panels at least partially forming the waste feed shaft wall lies in the range of 6 to 30. For example, a number of 2 to 14 for the longitudinal side wall and a number of at least 1 for the wide side wall may be envisaged.

It is preferable, further, that at least some of the panels are designed in the form of a rectangle with a length A and with a width B. Especially preferably, the length A in this case corresponds essentially to the height of the respective portion of the waste feed shaft wall. Typically, therefore, the length A lies in the range of approximately 3 to 6 m, in particular at approximately 5 m.

The width B preferably lies in a range of approximately 1 m.

The selected dimensions make it possible to ensure that, as regards both volume and weight, the panels have dimensions which allow relatively simple handling when the waste feed shaft wall is being mounted or demounted. In particular, it is conceivable that mounting or demounting takes place by means of the waste crane or by means of an auxiliary crane, such cranes having a load-bearing capacity sufficient for the corresponding panels. Moreover, as a rule, simple mounting aids, such as tie rods or brackets, are used in this case.

The present invention is illustrated further by means of the accompanying figures in which.

Figure 1:
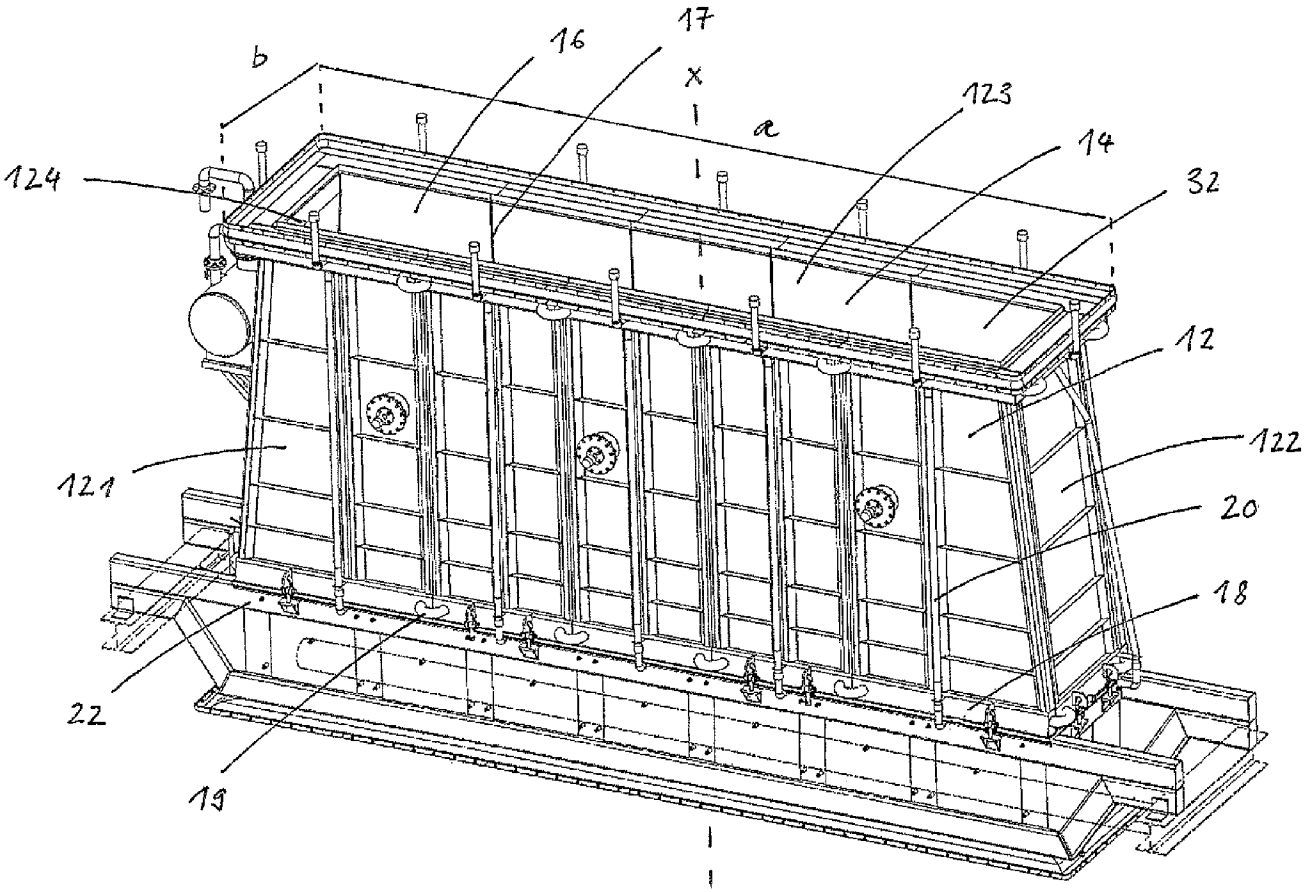
Fig. 1 PRIOR ART
FIG. 1 shows the waste feed shaft of a previously known waste feed device.

As shown in FIG. 1, the previously known waste feed shaft device has a waste feed shaft 14 surrounded by a waste feed shaft wall 12.

The waste feed shaft 14 has an axis X running parallel to the waste flow direction and, in cross section, a rectangular shape with a length a and a width b and, in the embodiment shown in concrete terms in FIG. 1, increases continuously in cross section in the waste flow direction.

Thus, in the embodiment shown, the waste feed shaft wall 12 is formed from four side walls 121, 122, 123, 124, in concrete terms two wide side walls 122, 124 formed at right angles or slightly trapezoidally and two trapezoidal longitudinal side walls 121, 123. The longitudinal side walls 121, 123 are formed in each case from plates 16 which are welded to one another and of which FIG. 1 shows five plates for the subwall 123. Weld seams 17 are therefore present between the plates 16 on the waste feed shaft wall inner surface 32 formed by the waste feed shaft wall 12. Moreover, as a rule, the previously known waste feed device shown has wearing plates welded on the waste feed shaft wall inner surface 32.

The waste feed shaft wall 12 formed from the side walls 121, 122, 123, 124 is welded in the lower region to a steel profile 18 running around horizontally, which lies on the truss-like supporting frame 22 and, in the previously known device, forms with this an integral part of the waste feed device. The reinforcing ribs 20, likewise shown in FIG. 1, prevent the waste feed shaft wall 12 from bulging out.

The overall waste shaft is cooled; the transfer of the coolant between the individual wall surface elements takes place via arcuate cooling medium ducts 19.

Figure 2:
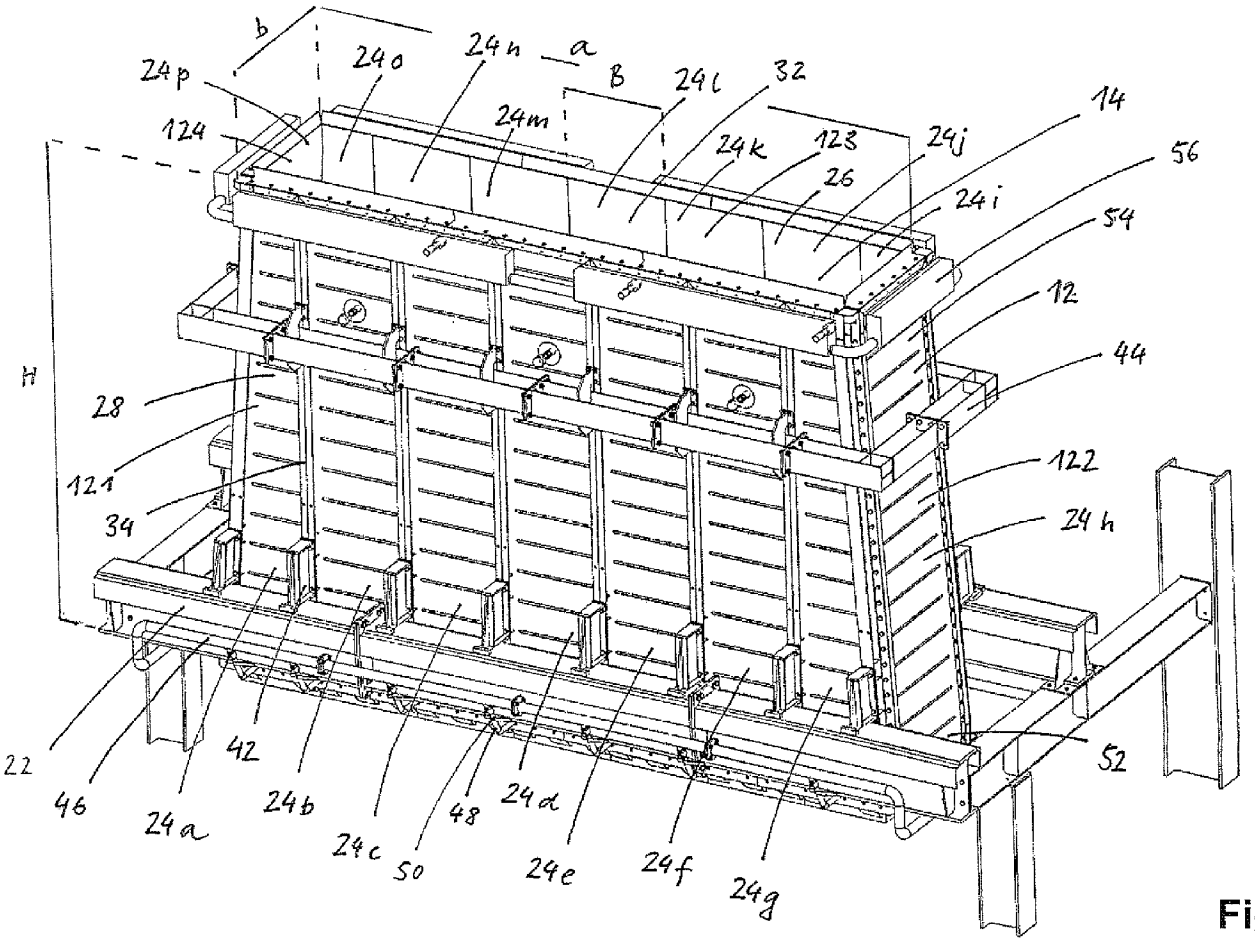
FIG. 2 shows the waste feed shaft of a waste feed device according to the invention.

In the waste feed device according to the invention, shown in FIG. 2, the waste feed shaft wall 12 is formed from sixteen separate panels 24*a-p*, the two longitudinal side walls 121, 123 being formed in each case from seven panels 24*a-g* and 24*i-o* and the two wide side walls 122, 124 are formed in each case from a single panel 24*h* and 24*p*.

The panels 24*a-p* extend in their longitudinal direction over the entire height H of the waste feed shaft 14. The length of the panels corresponds, for example, to 5 m.

Of the panels 24*a-g* and 24*i-o* of the longitudinal side walls 121, 123, in the embodiment shown the width B of the five panels 24*b-f* and 24*j-n* not arranged in each case at the margin is identical and is constant in the longitudinal direction, whereas, for the two panels 24*a*, 24*g* and 24*i*, 24*o* arranged at the margin, it increases continuously in the waste flow direction. In other words, the five panels 24*b-f* and 24*j-n* not arranged at the margin on the longitudinal side are rectangular, the width B of the rectangle amounting to approximately 1 m in the embodiment shown. For the panels arranged at the margin and preferably serving as length compensation elements, the width increases in the waste flow direction to a maximum of approximately 1 m.

Figure 3:
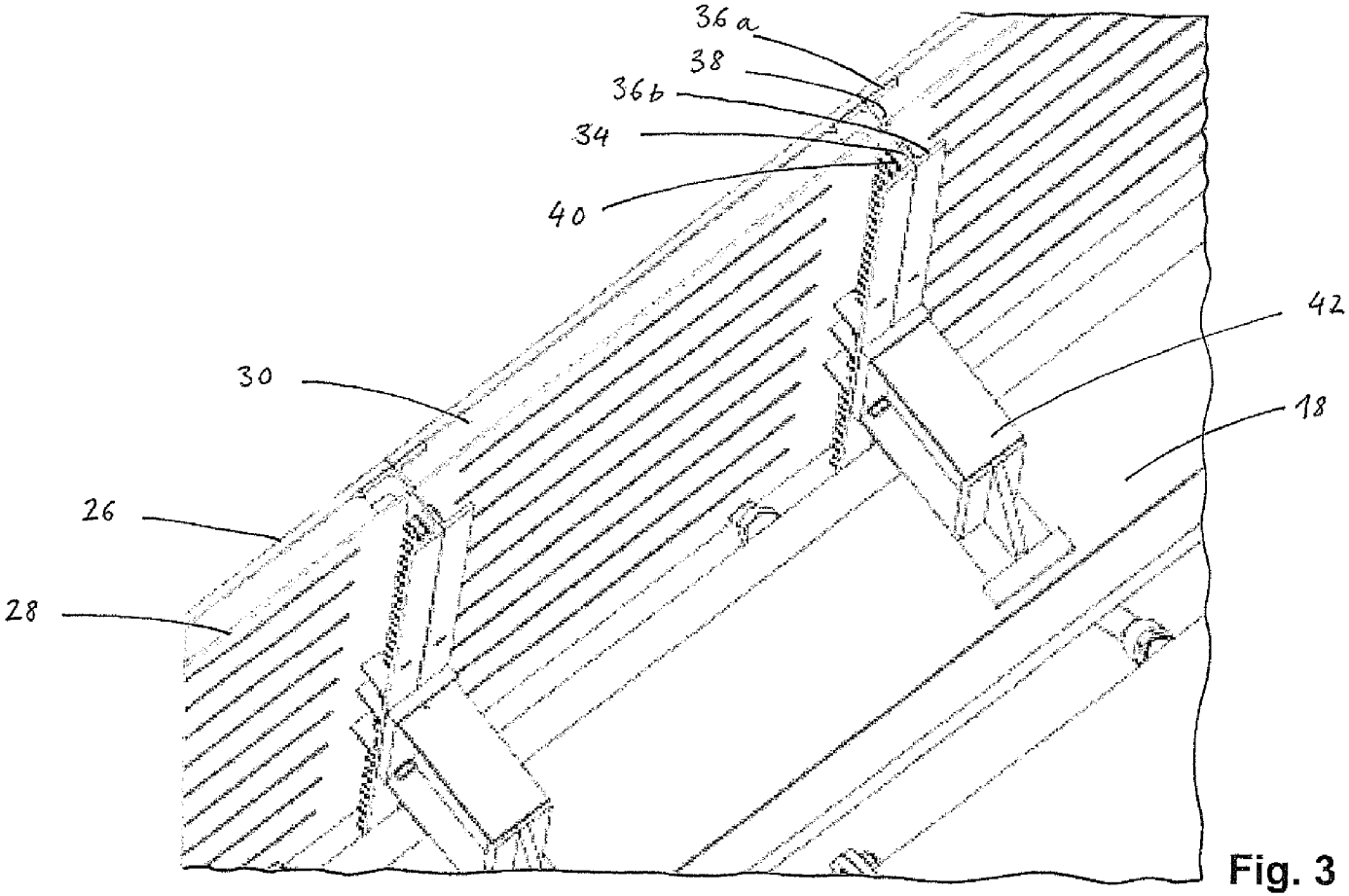
FIG. 3 shows a perspective view of a panel of the waste feed device according to the invention, shown in FIG. 2, in the section transverse to the longitudinal direction of the panel.

As will be gathered, for example, from FIG. 3, the panels 24*a-p* comprise a panel inner wall 26 and a panel outer wall 28 which is spaced apart from this and which with the panel inner wall 26 surrounds a panel cavity 30. Since, as shown in FIG. 2, each panel 24*a*-24*p* extends in its longitudinal direction over the entire height H of the waste shaft and is preferably formed from a single plate, the panel inner wall 26 forms a continuous surface. The panel inner walls 26 of all the panels 24*a-p* in this case form the waste feed shaft wall inner surface 32 which therefore has no horizontal steps.

As is shown further in FIG. 2 in combination with FIG. 3, in each case two adjacent panels of a longitudinal side wall 121, 123 are screwed releasably to one another by means of U-profiles 34. Consequently, the waste feed shaft inner surface 32 has no weld seam between the panels, as is the case in the previously known embodiment with plates welded to one another.

Each panel is assigned two U-profiles 34 bordering the panel on the longitudinal sides. The U-profile comprises two legs 36*a*, 36*b* and a web 38 arranged between them. In this case, a first leg 36*a* of the U-profile 34 is welded to the panel inner wall 26 on its inside facing away from the waste feed shaft 14, so that part of the web 38 of the U-profile 34 closes off the panel cavity 30 on its longitudinal side. In that part of the U-profile 34 which projects from the panel outer wall 28, screw holes 40 for the screw connection are provided.

The supporting frame 22 for carrying the panels 24*a-p* of the waste feed shaft wall 12 is, as shown in FIG. 2, arranged, on the outside, facing away from the waste feed shaft 14, of the waste feed shaft wall 12 (or of the panel outer wall 28), so as to be spaced apart from the latter. In this case, the support of the waste feed shaft wall 12 on the supporting frame 22 takes place by means of supporting elements 42 screwed to the U-profile 34. In concrete terms, the supporting elements 42 are screwed to the second leg 36*b* of the U-profile 34 in its portion projecting from the panel 24.

Further, the waste feed shaft wall 12 is supported by means of a binding band 44 screwed to the U-profile 34 in the upper third of the portion shown and running around the waste feed shaft 14 horizontally.

Figure 4:
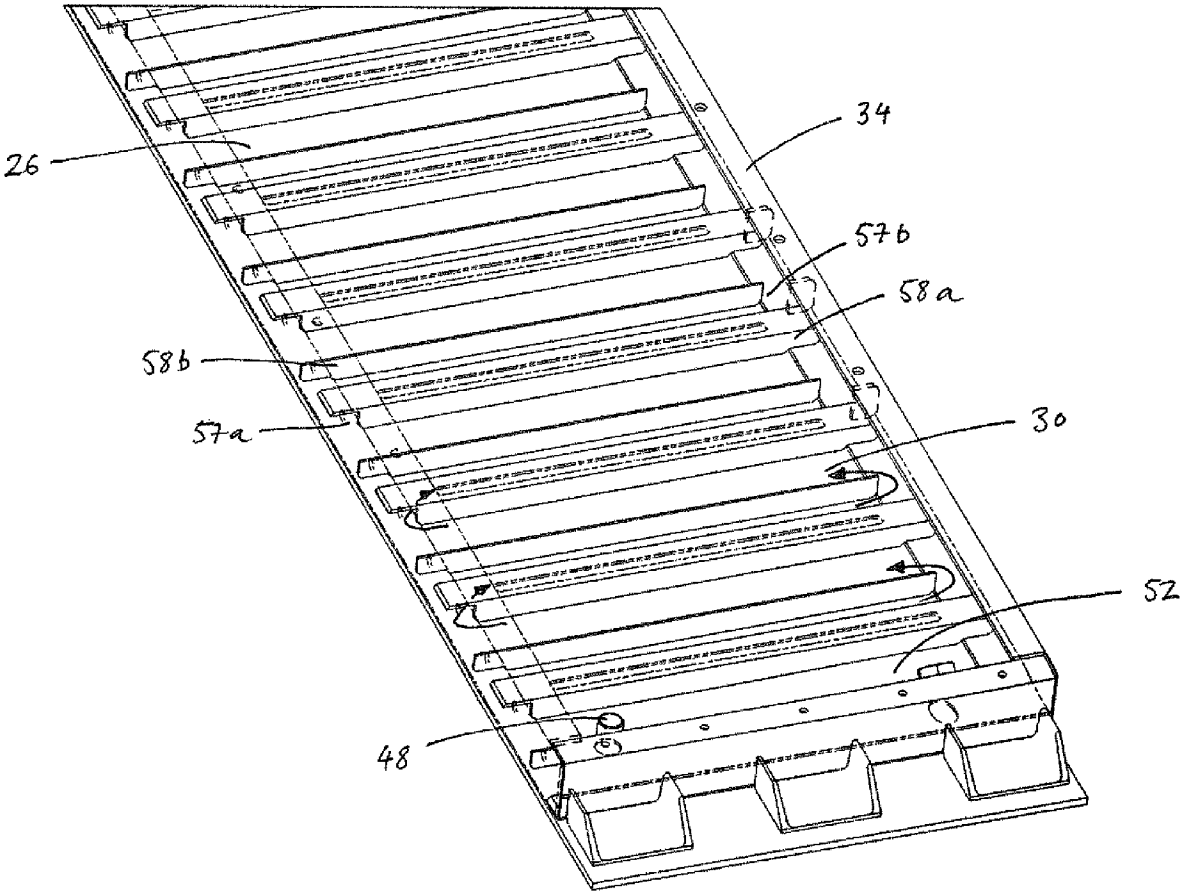
FIG. 4 shows a perspective view of the lower region of the panel shown in FIG. 2, in the open state without a panel outer wall.

According to the embodiments shown in FIG. 2, in combination with FIG. 4, each of the panels 24*a-p* is assigned a cooling medium supply line 48 branching off from a cooling medium ring line 46. Said cooling medium supply line 48 issues into a lower end region 52 of the panel cavity 30 and has means 50 for interrupting the supply of cooling medium to the respective panel cavity 30.

Figure 5:
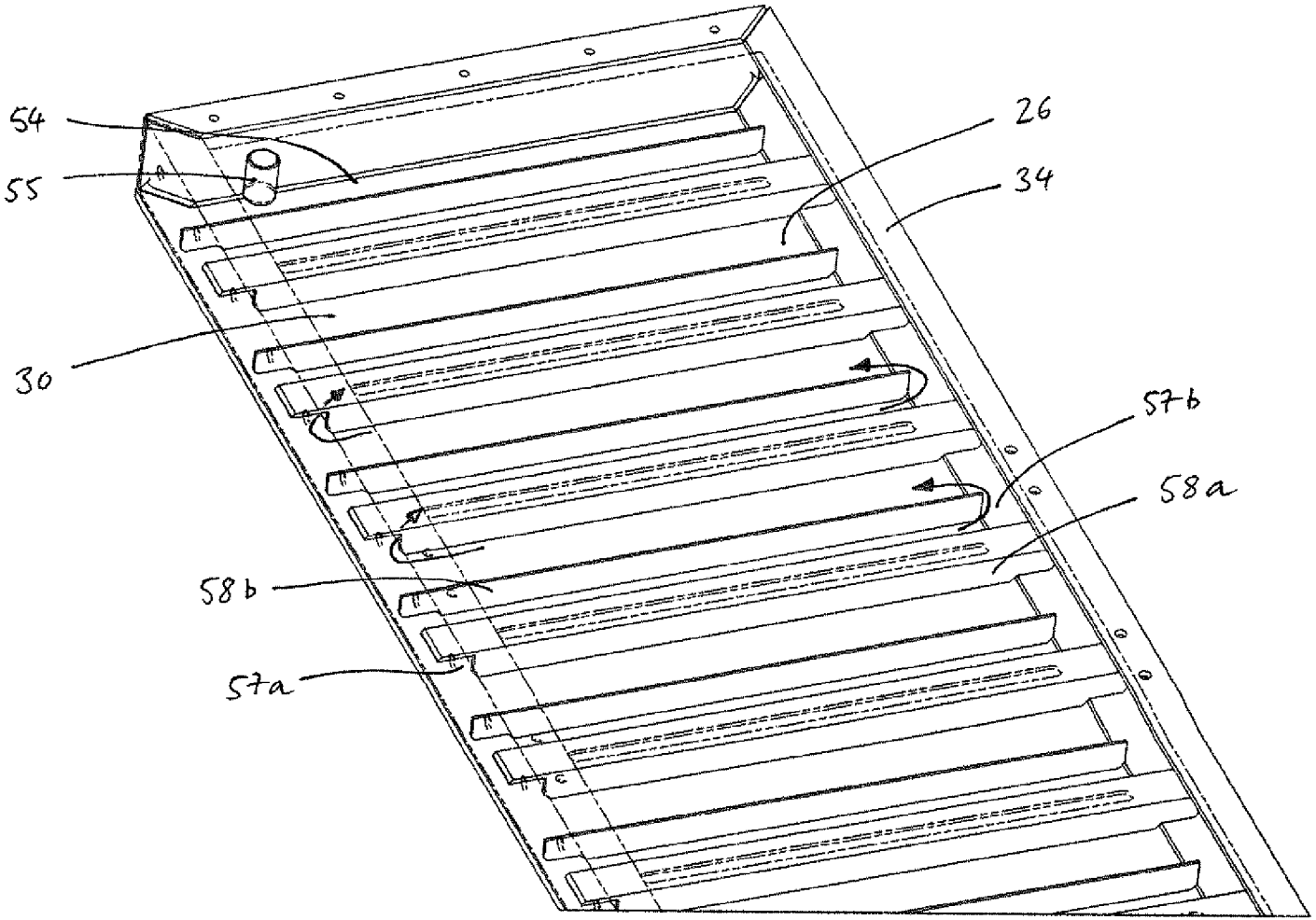
FIG. 5 shows a perspective view of the upper region of the panel shown in FIG. 2, in the open state without a panel outer wall.

As shown, for example, in FIGS. 4 and 5, during operation each panel is supplied with cooling water which flows in succession through the panel cavity 30 from the lower end region 52 as far as an upper end region 54. In the embodiments shown in FIGS. 4 and 5, in each case two deflecting ribs 58*a*, 58*b* succeeding one another in the axial direction of the waste feed shaft are arranged so as to be offset to one another, that is to say, as seen in the longitudinal direction of the panel, a flow passage 57*a* or 57*b* is located alternately on one panel longitudinal side and on the panel longitudinal side lying opposite this longitudinal side. In this case, a meandering flow path (indicated in FIGS. 4 and 5 by arrows) is followed, thus leading to highly efficient cooling. In the upper end region 54 of the panel cavity 30, the cooling water then passes via a cooling medium outlet 55 into an overflow gutter 56, shown in FIG. 2, where the cooling water is collected and is subsequently delivered, for example, for recooling.

In the event of damage, the supply of cooling water to the panel affected by the damage can be interrupted, and the module can be released from the composite structure by the release of the screw connection to the in each case adjacent panels, to the supporting elements and to the binding band and can be lifted out by means of a crane.

The invention claimed is:

1. A waste feed device for feeding waste into a combustion space of a waste incineration plant, comprising a waste feed shaft wall surrounding a waste feed shaft, at least part of the waste feed shaft wall is formed from a multiplicity of separate panels which are connected releasably to one another and which comprise, on their side facing the waste feed shaft, a panel inner wall and, on their side facing away from the waste feed shaft, a panel outer wall which is spaced apart from the panel inner wall and which with the panel inner wall surrounds a panel cavity.

2. The waste feed device as claimed in claim 1, further comprising a supporting frame for carrying the panels of the waste feed shaft wall, the supporting frame being arranged on the outside, facing away from the waste feed shaft, of the waste feed shaft wall and being connected releasably to the panels of the waste feed shaft wall.

3. The waste feed device as claimed in claim 2, the supporting frame being arranged so as to be spaced apart from the waste feed shaft wall.

4. The waste feed device as claimed in claim 1, in each case two adjacent panels being connected to one another via a screw connection.

5. The waste feed device as claimed in claim 1, the connecting line between two adjacent panels running parallel to the axial direction of the waste feed shaft.

6. The waste feed device as claimed in claim 1, the panel inner wall being formed continuously at least in its extent in the axial direction of the waste feed shaft.

7. The waste feed device as claimed in claim 1, the panel cavity being intended for receiving a cooling medium.

8. The waste feed device as claimed in claim 7, deflecting ribs which run parallel to one another being arranged between the panel inner wall and the panel outer wall in order to deflect the cooling medium.

9. The waste feed device as claimed in claim 8, in each case two deflecting ribs which succeed one another in the axial direction of the waste feed shaft being arranged so as to be offset to one another.

10. The waste feed device as claimed in claim 1, at least some of the panels being assigned in each case a cooling medium supply line issuing into the panel cavity, and the cooling medium supply line.

11. The waste feed device as claimed in claim 1, the overall number of panels which at least partially form the waste feed shaft wall lying in the range of 6 to 30.

12. The waste feed device as claimed in claim 1, at least some of the panels being designed in the form of a rectangle with a length and a width.

13. The waste feed device as claimed in claim 12, the length lying in the range of approximately 3 to 6 m.

14. The waste feed device as claimed in claim 12, the width lying in the range of at least approximately 1 m.

15. The waste feed device as claimed in claim 1, the weight of an individual panel lying in the range of approximately 1,000 to 2,000 kg.

* * * * *